US007194832B2

(12) United States Patent
Vazquez

(10) Patent No.: US 7,194,832 B2
(45) Date of Patent: Mar. 27, 2007

(54) SIGN

(76) Inventor: Carlos Reinaldo Vazquez, Calle 23 R-26 Lagos de Plata, Toa Baja, PR (US) 00949

( * ) Notice: Subject to any disclaimer, the term of this patent is extended or adjusted under 35 U.S.C. 154(b) by 198 days.

(21) Appl. No.: 10/776,175

(22) Filed: Feb. 12, 2004

(65) Prior Publication Data

US 2005/0055857 A1 Mar. 17, 2005

Related U.S. Application Data

(60) Provisional application No. 60/502,839, filed on Sep. 12, 2003.

(51) Int. Cl.
*G09F 13/04* (2006.01)

(52) U.S. Cl. ..... 40/574; 40/575; 40/576; 40/618

(58) Field of Classification Search ..... 40/578, 40/580, 575, 576, 579, 564, 664, 574, 618
See application file for complete search history.

(56) References Cited

U.S. PATENT DOCUMENTS 2,029,221 A * 1/1936 Burgess et al. ..... 40/574
4,387,522 A * 6/1983 Sommers-Szoszky ..... 40/576
4,765,080 A * 8/1988 Conti ..... 40/576
5,890,306 A * 4/1999 Smith ..... 40/576
6,367,180 B2 4/2002 Weiss et al.
6,557,284 B2 * 5/2003 Nolan ..... 40/574
6,658,774 B1 * 12/2003 Munter et al. ..... 40/574

* cited by examiner

*Primary Examiner*—Cassandra Davis
(74) *Attorney, Agent, or Firm*—George F. Wallace

(57) ABSTRACT

A sign includes a housing, and at least one symbol plate that provides a visual representation of at least one symbol. A symbol plate attaches to the housing in at least two orientations relative to the housing. Optionally, a symbol plate has at least one cutout that provides the visual representation. Optionally, the housing includes a light source that emits light waves that pass through cutouts to illuminate visual representations. Optionally, a sign includes a sheet, disposable between the housing and a symbol plate, and adapted to filter at least one color from the light waves. The at least two orientations can include a first position, and a second position 90 degrees to the first position. Optionally, a sign includes a cover, or a cover and a deluxe plate, having at least one respective opening that exposes the visual representation.

11 Claims, 4 Drawing Sheets

SIGN

CROSS-REFERENCE TO RELATED DOCUMENTS

This document claims the priority benefit, and incorporates by reference in its entirety, U.S. Provisional Patent Application No. 60/502,839 filed on Sep. 12, 2003 by VÁZQUEZ.

FIELD OF THE INVENTION

The present invention relates to signs that visually convey information, and more particularly, to address signs that visually convey address information.

BACKGROUND OF THE INVENTION

Signs are used to visually convey information. Address signs are used to convey visual address information, such as the address of a building, a house, or other type of structure or location, and can be affixed directly to a structure or displayed nearby. For example, address signs can be located near a street or road close to where a structure is located, such as on a mailbox, and can provide one or more street number, letters and/or names, for example.

BRIEF SUMMARY OF THE INVENTION

It is, therefore, a principle object of this invention to provide a sign.

It is another object of the invention to provide an address sign.

These and other objects of the present invention are accomplished by the sign disclosed herein.

The present invention provides a sign for visually conveying information.

In an exemplary embodiment of the present invention, a sign comprises a housing; and at least one symbol plate adapted to engage the housing in at least two orientations relative to the housing, with the at least one symbol plate including a visual representation of at least one symbol.

In an exemplary aspect of the invention, the at least two orientations includes a first position, and a second position that is 90 degrees to the first position.

In another exemplary aspect of the invention, the housing can include at least one slot, and the at least one symbol plate can include at least one tab adapted to attachably engage the at least one slot.

In a further exemplary aspect of the invention, the at least one symbol plate can include at least one symbol plate cutout that provides the visual representation of the at least one symbol; and the housing can include a light source that emits light waves, of at least one color, and that pass through at least a portion of the at least one plate cutout when the at least one plate is attached to said housing.

In still a further exemplary aspect of the invention, a sign can further include at least one sheet adapted to be disposed between the light source and at least one of the at least one symbol plate; where, when disposed between the light source and the at least one of the at least one symbol plate, the at least one sheet filters one or more of the at least one color from the light waves.

In yet another exemplary aspect of the invention, a sign can further include at least one sheet adapted to be disposed between the light source and at least one of the at least one symbol plate; where, when disposed between the light source and the at least one of the at least one symbol plate, the at least one sheet diffuses a portion of the light waves to prevent visual perception of the light source as a distinct image.

In still yet another exemplary aspect of the invention, a sign can further include a cover having at least one cover cutout; wherein the cover is adapted to attachably engage the housing with the at least one symbol plate being disposed between the cover and the housing, and wherein, when the cover is engaged with the housing, the at least one cover cutout is oriented to expose the visual representation of the at least one symbol.

In still a further exemplary aspect of the invention, a cover can be decorative.

In still yet a further exemplary aspect of the invention, a sign can further include a deluxe plate having at least one deluxe plate cutout; wherein the deluxe plate is adapted to attachably engage the housing with the at least one symbol plate and the cover disposed between the deluxe plate and the housing; and when the deluxe plate is engaged with the housing, the at least one deluxe plate cutout is oriented to expose the visual representation of at least one symbol.

In still yet another further exemplary aspect of the invention, a deluxe plate can be decorative.

BRIEF DESCRIPTION OF THE DRAWINGS

The present invention is illustrated by way of example and not limitation in the figures of the accompanying drawings, in which.

DETAILED DESCRIPTION OF THE INVENTION

The invention will now be described in more detail by way of example with reference to the embodiments shown in the accompanying figures. It should be kept in mind that the following described embodiments are only presented by way of example and should not be construed as limiting the inventive concept to any particular physical configuration or order.

According to the present invention, a sign visually conveys information, and its various elements described herein can be formed, in whole or in part, of one or more of plastic, stainless steel, metal, acrylic, wood, or any other desired material that does not defeat the present invention's function of visually conveying information.

Figure 1A:
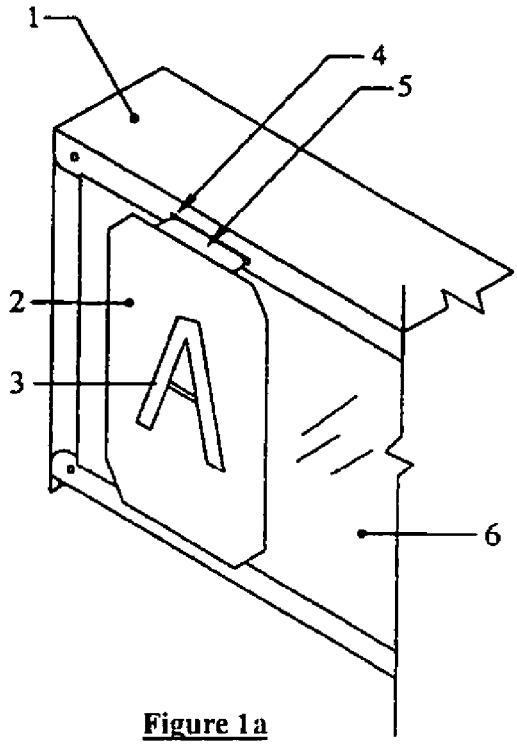
FIG. 1*a* illustrates an exemplary sign having a housing and at least one symbol plate attached to the housing in a first position relative to the housing.
Figure 1B:
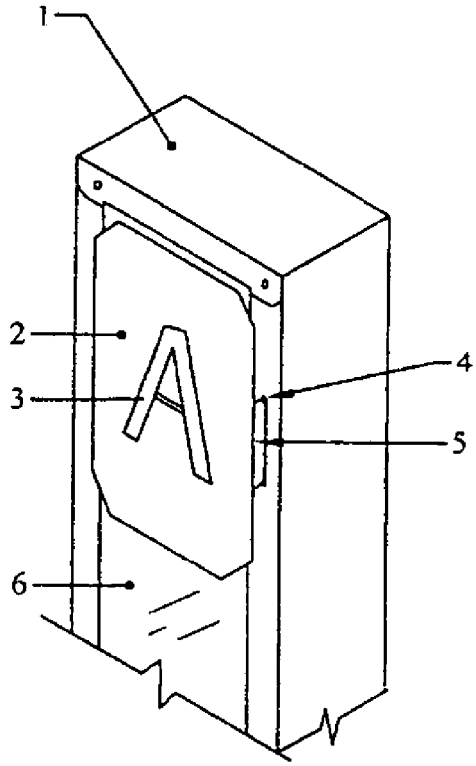
FIG. 1*b* illustrates an exemplary sign having a housing and at least one symbol plate attached to the housing in a second position relative to the housing.

As shown in FIG. 1*a*, according to an exemplary embodiment of the invention, a sign includes a housing 1, and at least one symbol plate 2 that provides a visual representation 3 of at least one symbol. Visual representation 3 can be provided in any manner, such as via one or more cutouts, one or more cutouts filled with a transparent material, or simply a symbol or symbols imprinted onto symbol plate 2, for example and not in limitation. Symbol plate 2 can be attached to housing 1 in at least two orientations relative to housing 1. For example, and not in limitation, FIG. 1*a* illustrates symbol plate 2 oriented in a first position such that housing 1 can be mounted or otherwise oriented in a horizontal position; while FIG. 1*b* illustrates symbol plate 2 oriented in a second position that is 90° to the first position, such that housing 1 can be mounted or otherwise oriented in a vertical position. However, the second position is not limited to 90°. Accordingly, this flexibility aspect of the present invention allows symbol plates 2, independently or collectively, to have varying orientations relative to housing 1 and/or relative to other symbol plates 2; and/or housing 1 to have varying orientations relative to a structure or frame (not shown), such as, for example, horizontally, vertically, diagonally, etc. relative to a structure, frame, post, or mount. FIGS. 1*a* and 1*b* further illustrate optional sheet 6 (described in further detail below).

Symbol plates 2 can be made of one or more of a translucent, semi-transparent, or opaque material. Optionally, where housing 1 can accommodate a plurality of symbol plates 2 and less than the plurality of symbol plates are required to visually convey desired information, a sign can also include null plates (not shown), which do not visually convey information, and can cover extra space of housing 1.

According to the present invention, a symbol can be any type of symbol that visually conveys information, such as, for example, a trademark, a number, an ASCII character, a religious symbol, a seasonal symbol, an ethnic symbol, a geographic symbol, and/or a holiday symbol. Further, where a symbol is language-based, it can be from any desired language, such as, for example and not in limitation, Arabic, Latin, or Chinese.

As illustrated in FIGS. 1*a* and 1*b*, in an exemplary embodiment of the invention, housing 1 can include at least one slot 4, and symbol plate 2 can include at least one tab 5 adapted to attachably engage slot 4. When so engaged, slot 4 and tab 5 cooperatively attach symbol plate 2 to housing 1. Optionally, at least one of housing 1 and symbol plate 2 can include a plurality of slots or tabs, respectively.

Figure 2:
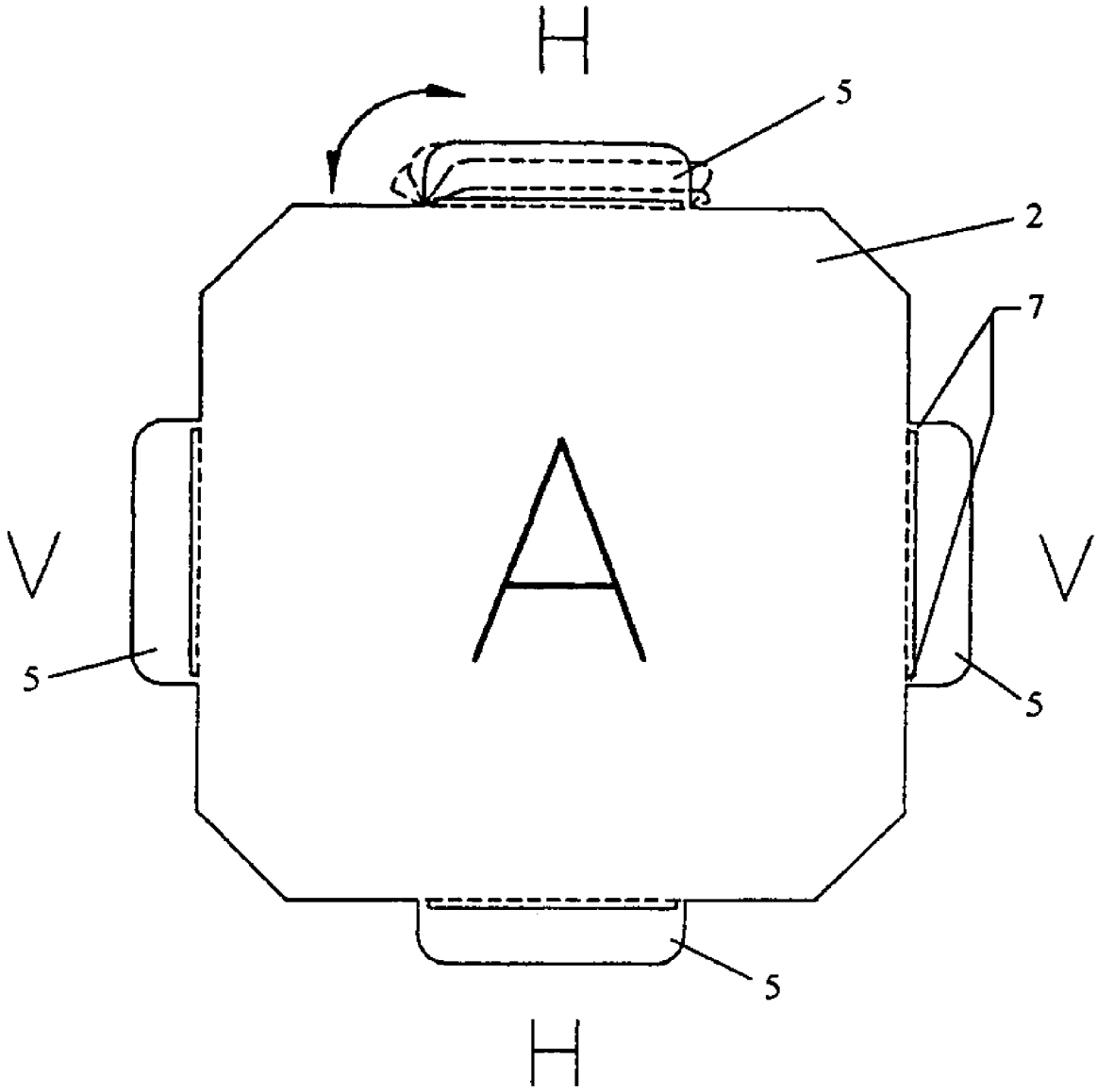
FIG. 2 illustrates an exemplary symbol plate having a plurality of tabs removably attached thereto via flanges.

Referring now to FIG. 2, in another exemplary embodiment of the invention, symbol plate 2 can include a plurality of tabs 5. Optionally, a particular tab 5, where unneeded or otherwise unwanted, can be adapted to be removable from symbol plate 2. For example and not in limitation, as illustrated in FIG. 2, tabs 5 can be removably attached to symbol plate 2 via at least one flange 7, which allows any of tabs 5 to be broken off from symbol plate 2. For example, where the at least one flange 7 is made of a pliable material, such as a metal, or a brittle material, such as a plastic, a particular tab 5 can be repeatedly, or initially, bent until the at least one flange 7 breaks, thereby removing a tab from symbol plate 2.

It should be noted that symbol plate 2 and housing 1 can be attached in any manner consistent with the functionality and spirit of the present invention, and such manners are readily apparent to one of ordinary skill in the art given this description. For example, attachment can be achieved via a screw-hole, pin-catch, or bolt-nut pair; or magnets or magnetic property of symbol plate 2 and/or housing 1, glue and/or any other form of attachment manner that is consistent with the functionality of the present invention. Further, such attachment can be permanent or removable, such as, for example, where symbol plate 2 and/or housing 1 is magnetic, or includes a magnetic portion.

As noted above, according to an exemplary aspect of the present invention, symbol plate 2 provides a visual representation 3 of at least one symbol. For example, visual representation 3 can include an imprinted, stamped, cutout, or otherwise visually displayed symbol. As shown in FIGS. 1*a* and 1*b*, symbol plate 2 can have at least one cutout 3 that defines the at least one symbol.

Figure 3:
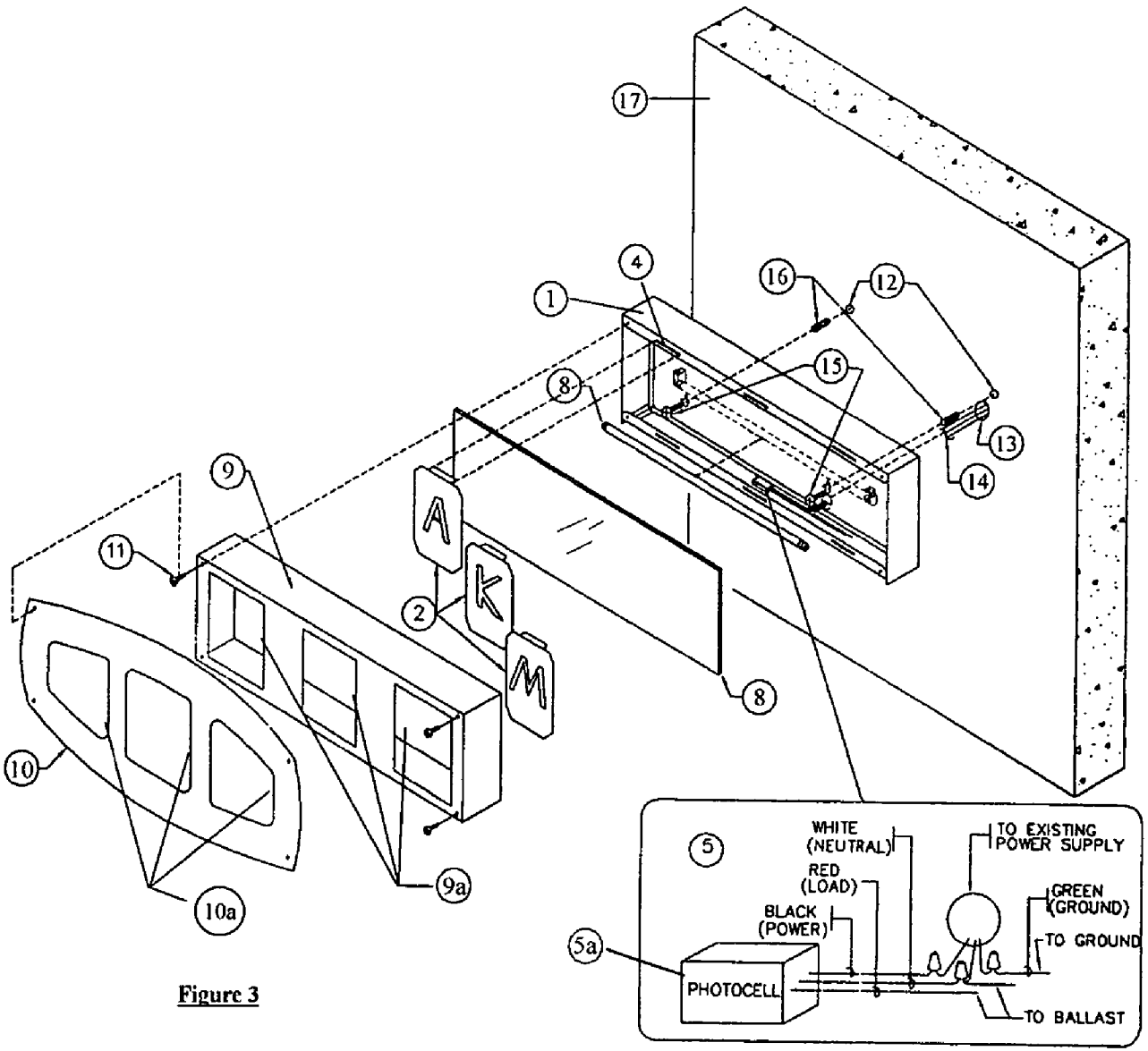
FIG. 3 illustrates an exemplary sign having the following optional elements: a light source, a sheet, a cover, and a deluxe plate.

According to another exemplary embodiment of the invention, as shown in FIG. 3, housing 1 can include a light source 8 that emits light waves (not shown) of at least one color, and visual representation 3 can be provided via at least one cutout. When symbol plate 2 is attached to housing 1, the emitted light waves pass through at least a portion of the visual representation, which provides an illuminated version of the at least one symbol. It should be noted that one or more cutouts can provide visual representation 3, which as noted above can represent one or more symbols. For example, multiple cutouts can define a symbol or symbols formed of "dotted" lines or plural segments, or a single cutout can define one or more symbols. Light source 8 can be any type of light source that is consistent with the spirit of the present invention, such as, for example, a fluorescent lamp (as illustrated in FIG. 3), a light emitting diode (not shown), or an incandescent light (not shown). Likewise, power for light source 8 can be any type of power source compatible with the particular light source provided. For example and not in limitation, a power source can include one or more batteries (optionally, rechargeable) and/or one or more solar cells. Further, a power source can be supplied by an existing power supply, such as one provided via a structure (for example and not in limitation, a home or commercial building). As illustrated in FIG. 3, wiring 14 of an existing power source can be accessed via a wiring hole 13 of a wall 17, such as for example and not in limitation, where housing 1 is mounted to an exterior wall of a building. Optionally, as also illustrated in FIG. 3, a photocell switch 5*a* can be further provided, in conjunction with any power source, to automatically turn off light source 8 during daylight or otherwise lighted situations. FIG. 3 further illustrates an exemplary power source implementation 5, in which photocell switch 5*a* is connected to an existing power supply; and a ballast, such as one utilized with a fluorescent light source.

In a further exemplary embodiment of the present invention, as illustrated in FIG. 3, a sign can optionally include at least one sheet 6 adapted to be disposed between light source 8 and at least one of the at least one symbol plate 2. Sheet 6 can be transparent, translucent, or opaque, for example and not in limitation. For example and not in limitation, sheet 6 can be made of an acrylic material. In one exemplary embodiment, sheet 6 is semi-transparent and when disposed between light source 8 and one or more of the at least one symbol plate 2, sheet 6 filters one or more of the at least one color from the light waves. Accordingly, sheet 6 can be adapted to alter the color characteristics of the light waves that illuminate the visual representation 3 of the at least one symbol. In another exemplary embodiment of the invention, sheet 6 can be translucent, so as to cause sufficient diffusion of the light waves to prevent perception of light source 8 as a distinct image, thereby providing a uniform area of illumination behind symbol plate 2, which uniformly illuminates visual representation 3. In yet another exemplary embodiment of the invention, sheet 6 can be opaque. Notably, as illustrated in FIG. 4, sheet 6 can be optionally included if no light source 8 is provided.

Figure 4:
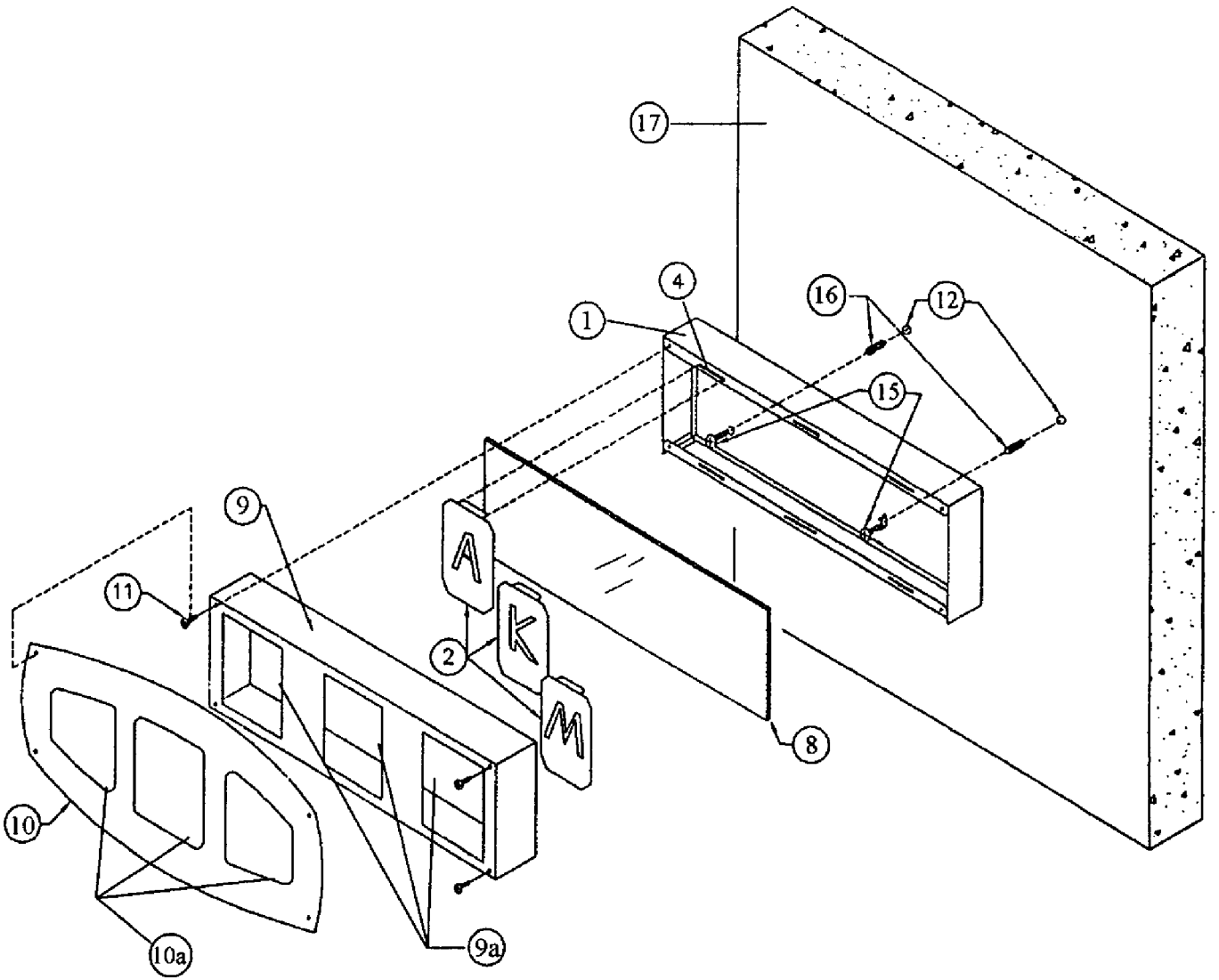
FIG. 4 illustrates an exemplary sign having the following optional elements: a sheet, a cover, and a deluxe plate.

According to yet a further exemplary embodiment of the invention, as shown in FIGS. 3 and 4, a sign can further include a cover 9 having at least one cover opening 9*a*. Cover 9 is adapted to attachably engage housing 1 with the at least one symbol plate 2 disposed between cover 9 and housing 1. Cover 9 can be engaged with housing 1 via any manner consistent with the functionality of the present invention. For example and not in limitation, as illustrated in FIGS. 3 and 4, cover 9 can be engaged with housing 1 via one or more screws 11. When cover 9 is engaged with housing 1, the at least one cover opening 9*a* is oriented to expose visual representations 3. Accordingly, where optional light source 8 is provided, as illustrated in FIG. 3, lights waves emitted from light source 8 that pass through cutouts 3 also pass through cover opening 9*a*, which allows visual perception of an illuminated visual representation 3.

According to yet another exemplary aspect of the invention, cover 9 can be decorative, so as to improve the visual appearance of the sign. For example, cover 9 can be made of a visually appealing material, such as brass, stainless steel, or other desired material or materials.

According to still yet another exemplary embodiment of the invention, a sign can further include a deluxe plate 10 having at least one deluxe plate opening 10*a*. Deluxe plate 10 is adapted to attachably engage housing 1 with the at least one symbol plate 2 and cover 9 disposed between deluxe plate 10 and housing 1. Deluxe plate 10 can be engaged with housing 1 via any manner consistent with the functionality of the present invention. For example and not in limitation, as illustrated in FIGS. 3 and 4, deluxe plate 10 can be engaged with housing 1 via one or more housing screws 11, which can also attach cover 9 to the housing. When deluxe plate 10 is engaged with housing 1, the at least one deluxe plate opening 10*a* is oriented to expose visual representation 3. And as with cover 10, where optional light source 8 is provided, as illustrated in FIG. 3, lights waves emitted from light source 8 that pass through cutouts 3 and cover opening 9*a* also pass through deluxe plate opening 10*a*, which allows visual perception of an illuminated visual representation 3. As illustrated in FIGS. 3 and 4, deluxe plate 10 can be formed to have a visually appealing shape.

It should be noted that cover 9 and/or deluxe plate 10 can be attached to housing 1 via any manner that is desirable and consistent with the spirit of the present invention. Similarly, housing 1 can be attached to a surface or wall (as shown in FIGS. 3 and 4) or other structure or frame via any manner that is desirable and consistent with the spirit of the present invention. For example and not in limitations, as illustrated in FIGS. 3 and 4, housing 1 can be attached to a surface 17, such as a wall, via one or more surface screws 15 that engage complementary anchors 16 fitted in provided anchor holes 12.

It will be apparent to one skilled in the art that the manner of making and using the claimed invention has been adequately disclosed in the above-written description of the exemplary embodiments and aspects taken together with the drawings.

It should be understood, however, that the invention is not necessarily limited to the specific embodiments, aspects, arrangement, and components shown and described above, but may be susceptible to numerous variations within the scope of the invention. For example, although the above-described exemplary aspects of the invention are believed to be particularly well suited for visually conveying address information, it is contemplated that the concepts of the present invention can be applied whenever it is desired to visually convey information. Also, where two components are attached together via pair-wise elements (e.g., tab and slot), either component can possess either element, insofar as the attachment function is not defeated. Accordingly, the specification and drawings are to be regarded in an illustrative and enabling, rather than a restrictive, sense.

Therefore, it will be understood that the above description of the embodiments of the present invention are susceptible to various modifications, changes, and adaptations, and the same are intended to be comprehended within the meaning and range of equivalents of the appended claims.

I claim:

1. A sign comprising:

a housing:

a cover having at least one cover cutout: and at least one symbol plate removably attached to said housing in at least two orientations relative to said housing, the at least two orientations including a first position and a second position that is 90 degrees to the first position;

wherein said at least one symbol plate includes a visual representation of at least one symbol, said cover is adapted to attachably engage said housing with said at least one symbol plate disposed between said cover and said housing when said cover is engaged with said housing the at least one cover cutout is oriented to expose the visual representation of the at least one symbol; wherein said housing includes at least one slot and said at least one symbol plate includes at least one tab adapted to attachably engage said at least one slot.

2. A sign, comprising a housing;

a cover having at least one cover cutout;

at least one symbol plate removably attached to said housing in at least two orientations relative to said housing, the at least two orientations including a first position, and a second position that is 90 degrees to the first position; and a deluxe plate having at least one deluxe plate cutout; wherein said at least one symbol plate includes a visual representation of at least one symbol, said cover is adapted to attachably engage said housing with said at least one symbol plate disposed between said cover and said housing, when said cover is engaged with said housing, the at least one cover cutout is oriented to expose the visual representation of the at least one symbol, said deluxe plate is adapted to attachably engage said housing with said at least one symbol plate and said cover disposed between said deluxe plate and said housing, and wherein, when said deluxe plate is engaged with said housing, the at least one deluxe plate cutout is oriented to expose the visual representation of at least one symbol; wherein said housing includes at least one slot, and said at least one symbol plate includes at least one tab adapted to attachably engage said at least one slot.

3. The sign of claim 2, wherein said at least one symbol plate includes at least one symbol plate cutout that provides the visual representation of the at least one symbol; and wherein said housing includes a light source that emits light waves, of at least one color, and that pass through at least a portion of the at least one symbol plate cutout when said at least one symbol plate is attached to said housing.

4. The sign of claim 3, further comprising at least one sheet adapted to be disposed between the light source and at least one of said at least one symbol plate;

wherein, when disposed between the light source and the at least one of said at least one symbol plate, said at least one sheet filters one or more of the at least one color from the light waves.

5. The sign of claim 3, further comprising at least one sheet adapted to be disposed between the light source and at least one of said at least one symbol plate;

wherein, when disposed between the light source and the at least one of said at least one symbol plate, said at least one sheet diffuses a portion of the light waves to prevent visual perception of the light source as a distinct image.

6. A sign, comprising a housing;

a cover having at least one cover cutout;

at least one symbol plate removably attached to said housing in at least two orientations relative to said housing; and a deluxe plate having at least one deluxe plate cutout;

wherein said at least one symbol plate includes a visual representation of at Yeast one symbol, said at least one symbol plate includes at least one symbol plate cutout that provides the visual representation of the at least one symbol said housing includes a light source that emits light waves, of at least one color, and that pass through at least a portion of the at least one symbol plate cutout when said at least one symbol plate is attached to said housing, said cover is adapted to attachably engage said housing with said at least one symbol plate disposed between said cover and said housing, when said cover is engage with said housing, the at least one cover cutout is oriented to expose the visual representation of the at least one symbol, said deluxe plate is adapted to attachably engage said housing with said at least one symbol plate and said cover disposed between said deluxe plate and said housing, and wherein, when said deluxe plate is engaged with said housing, the at least one deluxe plate cutout is oriented to expose the visual representation of the at least one symbol;

wherein said housing includes at least one slot, and said at least one symbol plate includes at least one tab adapted to attachably engage said at least one slot.

7. A sign, comprising:

a housing;

at least one symbol plate adapted to engage said housing in at least two orientations relative to said housing; and a cover having at least one cover cutout;

wherein said at least one symbol plate includes a visual representation of at least one symbol, said housing includes at least one slot, said at least one symbol plate includes at least one tab adapted to attachably engage said at least one slot, said cover is adapted to attachably engage said housing with said at least one symbol plate disposed between said cover and said housing, and wherein, when said cover is engaged with said housing, the at least one cover cutout is oriented to expose the visual representation of the at least one symbol.

8. The sign of claim 7, wherein said at least one symbol plate includes at least one symbol plate cutout that provides the visual representation of the at least one symbol; and wherein said housing includes a light source that emits light waves, of at least one color, and that pass through at least a portion of the at least one symbol plate cutout when said at least one symbol plate is attached to said housing.

9. The sign of claim 7, further comprising a deluxe plate having at least one deluxe plate cutout;

wherein said deluxe plate is adapted to attachably engage said housing with said at least one symbol plate and said cover disposed between said deluxe plate and said housing, and wherein, when said deluxe plate is engaged with said housing, the at least one deluxe plate cutout is oriented to expose the visual representation of at least one symbol.

10. The sign of claim 8, further comprising at least one sheet adapted to be disposed between the light source and at least one of said at least one plate;

wherein, when disposed between the light source and the at least one of said at least one symbol plate, said at least one sheet filters one or more of the at least one color from the light waves.

11. The sign of claim 8, further comprising at least one sheet adapted to be disposed between the light source and at least one of said at least one symbol plate;

wherein, when disposed between the light source and the at least one of said at least one symbol plate, said at least one sheet diffuses a portion of the light waves to prevent visual perception of the light source as a distinct image.

* * * * *